US006071102A

United States Patent [19]

Hjelsand

[11] Patent Number: 6,071,102

[45] Date of Patent: Jun. 6, 2000

[54] FLOATING SEAL FOR SEALED STAR GEROTOR

[75] Inventor: Timothy A. Hjelsand, Waconia, Minn.

[73] Assignee: Eaton Corporation, Cleveland, Ohio

[21] Appl. No.: 08/864,612

[22] Filed: May 28, 1997

[51] Int. Cl.[7] ..... F01C 1/10; F01C 19/08

[52] U.S. Cl. ..... 418/61.3; 418/142

[58] Field of Search ..... 418/61.3, 142

[56] References Cited

U.S. PATENT DOCUMENTS

| | | | |
|---|---|---|---|
| 3,801,239 | 4/1974 | Larson | 418/61.3 |
| 4,116,593 | 9/1978 | Jones | 418/142 |
| 4,145,167 | 3/1979 | Baatrup | 418/61.3 |
| 5,080,567 | 1/1992 | White, Jr. | 418/61.3 |

*Primary Examiner*—John J. Vrablik
*Attorney, Agent, or Firm*—L. J. Kasper

[57] ABSTRACT

A steering control unit having a gerotor gear set (15) including a ring member (35) and a star member (37) which orbits and rotates within the ring. Adjacent the rearward surface (49) of the star (37) is and end cap (17). The invention provides an improved sealed star arrangement, in which the star defines an annular groove (51) in which are disposed a seal ring (55) and a backup ring (57). In accordance with the invention, the inside diameter (61) of the backup ring (57) is less than the diameter of the inner surface (59) of the groove, such that there is a radial squeeze on the backup ring (57). The axial dimension of the seal ring (55) and backup ring (57) together is less than the axial dimension of the groove (51), so there is no axial squeeze on the rings, thus eliminating the binding of the gerotor star which has been common with prior art sealed star arrangements.

8 Claims, 2 Drawing Sheets

FLOATING SEAL FOR SEALED STAR GEROTOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure devices of the type including a gerotor displacement mechanism, and more particularly, to those of the "sealed star" type.

Although the present invention may be used advantageously in a gerotor motor or a gerotor pump, it is especially suited for use in a fluid controller such as the steering control unit (SCU) of a full fluid-linked hydrostatic power steering system, and the invention will be described in connection therewith.

Those skilled in the SCU art have, for many years, been attempting to reduce "wheel slip", i.e., a condition whereby, when the steering cylinder reaches the end of its travel, the steering wheel is still able to be rotated by the vehicle operator, as a result of fluid leakage within the SCU. Typically, the leakage is occurring between the rearward surface of the gerotor star and an adjacent surface of an endcap member.

One conventional way of dealing with the problem of wheel slip is to reduce the gerotor side clearance and increase the torque on the bolts which fasten the gerotor gear set and the end cap to the main housing of the SCU. However, in certain SCU applications, increased bolt torque is undesirable because it can cause binding of the gerotor star, and it is necessary to reduce wheel slip in some other manner. Binding of the gerotor star is undesirable because it interferes with the precise metering characteristics of the SCU, and effects manual steering and the follow-up capability.

U.S. Pat. No. 4,145,167 illustrates one approach utilized by those skilled in the SCU art, the approach being referred to as a "sealed star" in which a sealing arrangement is disposed on the rearward surface of the gerotor star, in sealing engagement with the adjacent surface of the endcap. In the conventional, prior art, sealed star arrangements, the intention is to prevent leakage of fluid through the gerotor side clearance to the case drain region of the SCU, which is connected to the system reservoir. In this prior art arrangement, the sealing is accomplished by means of an axial squeeze of the seal assembly, i.e., by compressing the seal assembly axially between the bottom surface of the seal groove and the adjacent surface of the endcap.

In many SCU applications, the conventional "axial squeeze" type of sealed star arrangement has been generally satisfactory. However, one inherent disadvantage of the prior art sealed star was that the amount of axial squeeze on the seal assembly was critical, and had to be accurately controlled. Obviously, insufficient squeeze on the seal assembly would likely result in leakage, thus permitting wheel slip. On the other hand, excessive squeeze on the seal assembly would require excessive input torque in order to manually rotate the gerotor star (as is required for manual steering).

BRIEF SUMMARY OF THE INVENTION

Accordingly, it is an object of the present invention to provide an improved sealed star arrangement for a rotary fluid pressure device having a gerotor displacement mechanism, wherein the sealed star overcomes the disadvantages of the prior art.

It is a more specific object of the present invention to provide such an improved sealed star arrangement which eliminates the criticality of the amount of axial squeeze on the seal assembly.

The above and other objects of the invention are accomplished by the provision of a rotary fluid pressure device of the type comprising housing means defining a fluid inlet port and a fluid outlet port. A gerotor displacement mechanism is associated with the housing means, and includes an internally-toothed ring member, and an externally-toothed star member eccentrically disposed within the ring member for orbital and rotational movement relative thereto. The teeth of the ring member and the star member interengage to define a plurality of expanding and contracting fluid volume chambers in response to the orbital and rotational movements. A valve means is operably associated with the housing means and with the star member to provide fluid communication from the inlet port to the expanding volume chambers and from the contracting volume chambers to the outlet port.

The ring member and the star member each include a forward surface disposed toward the valve means, and a rearward surface, the housing means including an endcap disposed in sealing engagement with the rearward surfaces of the ring member and the star member. The rearward surface of the star member defines a generally annular seal groove and seal means disposed in the seal groove.

The improved rotary fluid pressure device is characterized by the seal groove defining a radially inner surface and a radially outer surface. The seal means comprises an annular seal ring disposed in the seal groove and in engagement with the endcap, and an annular elastomeric back-up ring disposed in the seal groove, forward of the seal ring. The back-up ring is configured such that its inside diameter is smaller than the radially inner surface of the seal groove, and the axial dimension of the seal ring and the back-up ring together is no greater than the axial dimension of the seal groove. In other words, there is no axial squeeze on the seal assembly, but a radial squeeze on the back-up ring, while the seal ring floats.

DETAILED DESCRIPTION OF THE PREFERRED EMBODIMENT

Figure 1:
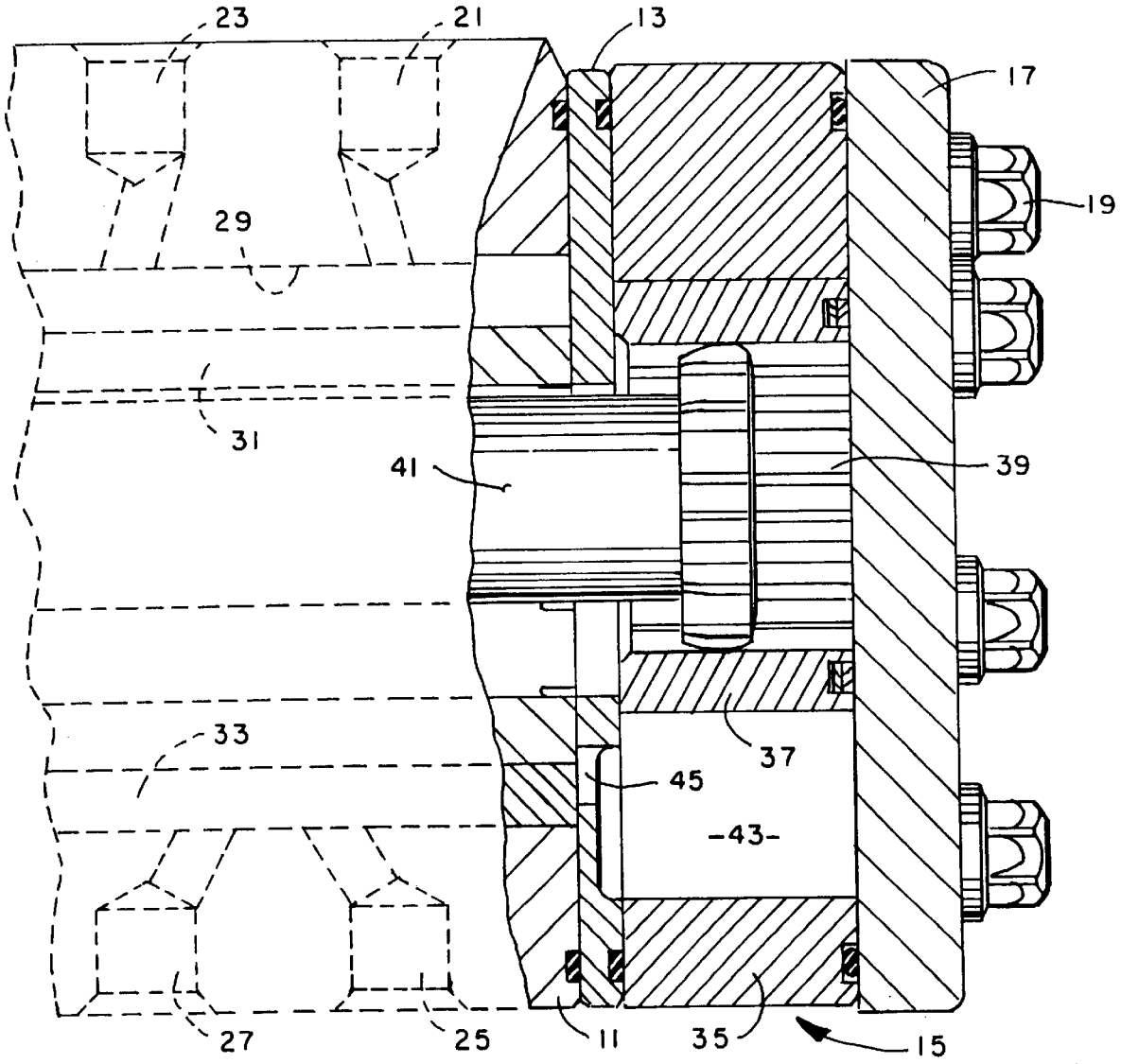
FIG. 1 is a fragmentary view, partly in axial cross-section, and partly in somewhat schematic cross-section, illustrating an SCU of the type with which the present invention may be utilized.

Referring now to the drawings, which are not intended to limit the invention, FIG. 1 is a partly schematic, partly axial cross-section view of a fluid controller, or steering control unit (SCU) of the type with which the sealed star arrangement of the present invention may be utilized.

The SCU may be of the general type illustrated and described in U.S. Pat. No. Re. 25,126, and more specifically, of the type illustrated and described in U.S. Pat. No. 4,958,493, both of which are assigned to the assignee of the present invention and incorporated herein by reference. In view of the above incorporation, the SCU will be described only very briefly herein, as the present invention does not involve or require any substantial modification of the rest of the SCU, or change its general operation.

The SCU comprises several sections, including a valve housing section 11, a wear plate 13, a gerotor displacement mechanism generally designated 15, and an endcap 17.

These sections are held together in tight sealing engagement by means of a plurality of bolts 19, which are in threaded engagement with the valve housing 11. The valve housing 11 defines a fluid inlet port 21, a fluid return port 23, and a pair of control (cylinder) fluid ports 25 and 27.

The valve housing 11 defines a valve bore 29, and rotatably disposed therein is the controller valving which comprises a primary, rotatable valve member (spool) 31, and a cooperating, relatively rotatable follow-up valve member (sleeve) 33.

The gerotor displacement mechanism 15 may be of the type well known in the art, and includes an internally toothed ring member 35, and an externally toothed star member 37. The star member 37 is eccentrically disposed within the ring member 35, for orbital and rotational movement therein. The star 37 defines a set of internal splines 39, and in splined engagement therewith is a main drive shaft 41, the forward end of which (not shown in FIG. 1) is in driving engagement with the follow-up valve member 33, in a manner, and for a purpose well known to those skilled in the art. The teeth of the ring 35 and the star 37 interengage to define a plurality of fluid volume chambers 43 (only one of which is shown in FIG. 1), each of the volume chambers 43 being in communication with the SCU valving through an adjacent opening 45 in the wear plate 13. Although the invention is being illustrated and described in connection with an SCU in which the ring 35 is stationary, and the star 37 orbits and rotates, such is not essential. What is essential to the invention is that there be relative orbital and rotational movement between the ring and the star.

As is well known to those skilled in the SCU art, when the vehicle operator rotates the steering wheel (not shown), the primary valve 31 rotates, relative to the follow-up valve 33, and opens appropriate orifices. As a result, fluid communication occurs from the inlet port 21 through the orifices in the valve members 31 and 33, and fluid flows to certain of the volume chambers 43, causing orbital and rotational movement of the star 37.

Fluid flows from other of the volume chambers 43 back through the valving, and out to one of the control ports 25 or 27, depending upon the direction of rotation of the steering wheel. Fluid returns from the steering cylinder through the other of the control ports, then flows through the valving and eventually out the return port 23 to the system reservoir (not shown).

As is also well known to those skilled in the art, typically the axial length of the ring member 35 is slightly greater than that of the star member 37, such that the ring 35 is truly in a tight sealing engagement between the wear plate 13 and the end cap 17, whereas the star 37 is free to orbit and rotate, within the ring 35, with some end clearance between the end faces of the star 37 and the adjacent surfaces of the wear plate 13 and the end cap 17. However, the end clearances on the ends of the star 37 are sufficiently small that both the ring and the star may be referred to as being "in sealing engagement" with both the wear plate 13 and the end cap 17.

Figure 2:
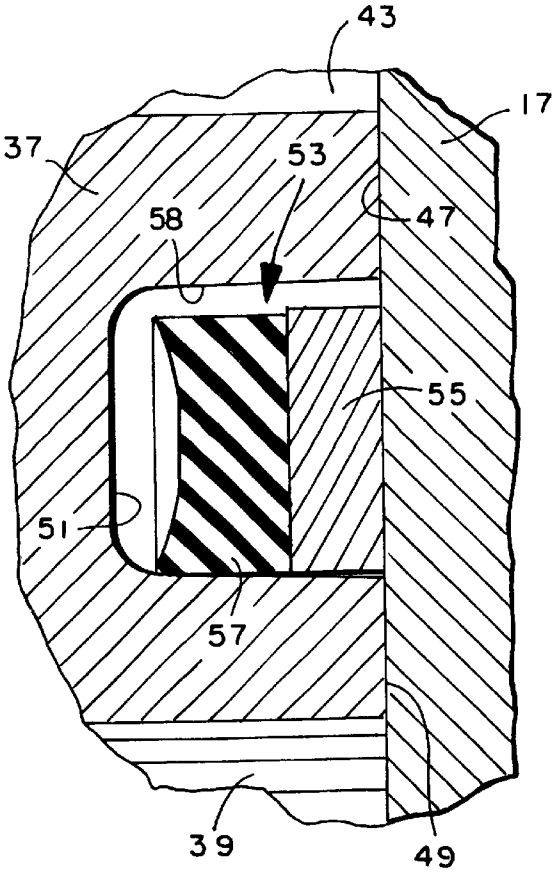
FIG. 2 is an enlarged, fragmentary, axial cross-section, illustrating the sealed star arrangement of the present invention.

Those elements described up to this point are conventional and generally well known to those skilled in the art. Referring now primarily to FIG. 2, the invention will be described in some detail. The end cap 17 includes a forward surface 47 disposed immediately adjacent a rearward surface 49 of the star member 37. The star 37 defines an annular groove 51 which is typically disposed concentrically about the axis of the star 37.

It is one benefit of the present invention that the axial depth of the groove 51 is not critical, as was the case for the prior art "axial squeeze" seal arrangement. Disposed within the annular groove 51 is a seal assembly, generally designated 53, comprising a steel seal ring 55, and an elastomeric back up ring 57 disposed "under" or forwardly of the seal ring 55. It will be understood by those skilled in the art that the particular materials used for the seal ring 55 and the backup ring 57 are not essential features of the present invention, and the rings 55 and 57 may comprise any of a number of materials conventionally used for such purposes.

It should also be clear from viewing FIG. 2 that there is no axial squeeze on the seal assembly 53, i.e., the axial dimension of the seal ring 55 and the backup ring 57 together is no greater than the axial dimension of the seal groove 51, and in the subject embodiment, the axial dimension of the seal assembly 53 is substantially less than that of the groove 51.

Figure 3:
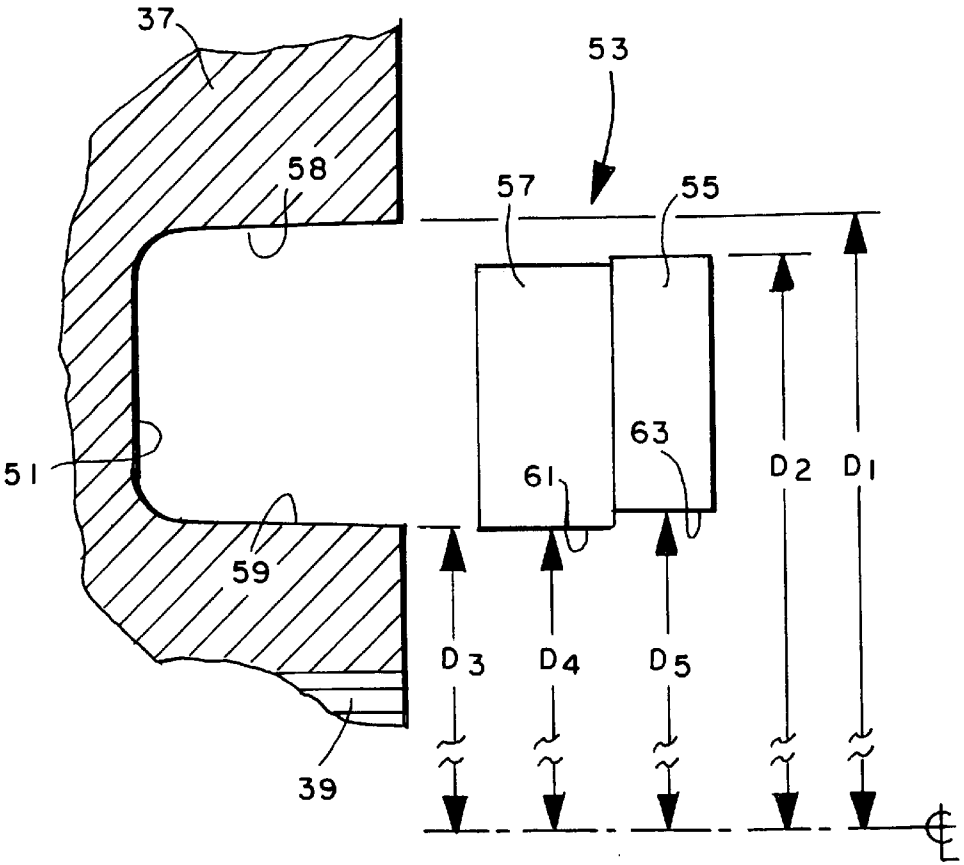
FIG. 3 is an outline view, in a disassembled condition, similar to FIG. 2, but illustrating the various dimensional relationships which are a significant aspect of the present invention.

Referring still primarily to FIG. 2, but now also in conjunction with FIG. 3, the annular seal groove 51 includes a radially outer surface 58, and a radially inner surface 59.

In FIG. 3, the seal assembly 53 is illustrated in its "relaxed" condition, prior to assembly into the seal groove 51. The primary purpose of FIG. 3 is to illustrate various dimensional relationships which are an important aspect of the present invention.

Referring now primarily to FIG. 3, the radially outer surface 58 defines a diameter D1 while the seal ring 55 and backup ring 57 define an outer diameter D2, wherein D2 is somewhat less than D1. In FIG. 3, the outer diameters of the rings 55 and 57 have been shown as approximately equal, although such is not essential to the invention. Thus, as may be seen in FIG. 2, there is at least some radial clearance between the outer surface 58 and the outer peripheries of the rings 55 and 57, for purposes which will be explained subsequently.

The radially inner surface 59 of the groove 51 defines a diameter D3. The backup ring 57 includes an inside diameter 61 which defines a diameter D4, while the seal ring 55 includes an inside diameter 63 which defines a diameter D5. In accordance with one important aspect of the invention, the diameter D4 is less than the diameter D3, such that there is a "radial squeeze" on the elastomeric backup ring 57 after "assembly" to the FIG. 2 position, while the diameter D5 is greater than the diameter D3, such that the seal ring 55 is free to "float" within the seal groove 51, after assembly.

Referring again primarily to FIG. 2, the operation of the sealed star of the present invention will now be described. During operation, and especially at the end of the travel of the steering cylinder, a small amount of the pressurized fluid in the volume chamber 43 leaks radially inward, between the adjacent surfaces 47 and 49. When the leakage fluid reaches the seal groove 51, it enters the groove and flows between the radially outer surface 58 and the outer peripheries of the rings 55 and 57. The leakage fluid eventually fills the space between the bottom of the groove 51 and the "forward" surface (left hand surface in FIG. 2) of the backup ring 57. As a result of the radial squeeze between the inner surface 59 and the inside diameter 61 of the backup ring 57, fluid is trapped forwardly of the backup ring 57 and exerts a pressure, biasing the backup ring 57 and seal ring 55 into sealing engagement with the adjacent forward surface 47 of the end cap 17, effectively sealing thereagainst, such that there is no substantial flow of leakage fluid from the volume chambers 43 past the seal ring 55. Therefore, there is no substantial wheel slip with the present invention.

As soon as the pressure in the volume chamber 43 is relieved, such as by returning the valve members 31 and 33 to the neutral position, the pressure forward of the backup ring 57 is relieved, and the biasing force on the seal assembly 53 is likewise relieved. Excessive drag from the seal ("seal drag") against the end cap is prevented, whereby the gerotor star is free to move, thus promoting good steering characteristics.

When manually steering, there is no axial squeeze, as in the prior art, and the only "friction" is the result of the bias of the seal ring 55. However, as is well known to those skilled in the art, manual steering normally generates pressures in the range of about 200 to 400 psi., which, when applied to the seal ring 55, is insufficient to cause any undesirable resistance to manual steering. Thus, the present invention substantially eliminates wheel slip, but with a frictional drag that is approximately proportional to the need for sealing, i.e., the pressure of the leakage fluid.

As was mentioned previously, the present invention is not limited to any particular materials for the seal ring 55 and backup ring 57, but instead, any suitable materials may be used which will function satisfactorily. For example, in some applications the seal ring 55 could comprise a suitable plastic material. Also, although the invention has been illustrated and described in connection with a seal ring 55 and a backup ring 57 which are both shown as having rectangular cross-sections, the invention is not so limited. For example, the backup ring 57 could comprise an O-ring, as long as its "inside diameter" would have a radial squeeze relative to the inner surface 51. It is believed that various other materials and shapes will occur to those skilled in the art in dealing with different applications.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary fluid pressure device of the type comprising housing means defining a fluid inlet port and a fluid outlet port; a gerotor displacement mechanism associated with said housing means, and including an internally-toothed ring member, and an externally-toothed star member eccentrically disposed within said ring member for orbital and rotational movement relative thereto, the teeth of said ring member and said star member interengaging to define a plurality of expanding and contracting fluid volume chambers in response to said orbital and rotational movements; valve means operably associated with said housing means and with said star member to provide fluid communication from said inlet port; to said expanding volume chambers and from said contracting volume chambers to said outlet port; said ring member and said star member each including a forward surface disposed toward said valve means, and a rearward surface, said housing means including an endcap disposed in sealing engagement with said rearward surfaces of said ring member and said star member; said rearward surface of said star member defining a generally annular seal groove and seal means disposed in said seal groove; characterized by:

(a) said seal groove defining a radially inner surface and a radially outer surface;

(b) said seal means comprising an annular seal ring disposed in said seal groove and in engagement with said endcap, and an annular elastomeric back-up ring disposed in said seal groove, forward of said seal ring; and (c) said back-up ring being configured such that its inside diameter is smaller than said radially inner surface of said seal groove, and the axial dimension of said seal ring and said back-up ring together is no greater than the axial dimension of said seal groove.

2. A rotary fluid pressure device as claimed in claim 1, characterized by said device comprising a fluid controller, said housing means defining first and second control fluid ports adapted for connection to a fluid pressure operated device, and said valve means including a primary rotatable valve member, and a relatively rotatable follow-up valve member.

3. A rotary fluid pressure device as claimed in claim 2, characterized by means operable to transmit said rotational movement of said star member into follow-up movement of said follow-up valve member.

4. A rotary fluid pressure device as claimed in claim 1, characterized by said back-up ring being configured such that its outside diameter is smaller than said radially outer surface of said seal groove, whereby leakage fluid from said contracting fluid volume chambers flows radially inward along said rearward surface of said star member and enters said seal groove.

5. A rotary fluid pressure device as claimed in claim 4, characterized by said axial dimension of said seal ring and said back-up ring together is less than said axial dimension of said seal groove, whereby said leakage fluid in said seal groove flows into a chamber forward of said back-up ring, biasing said back-up ring and said seal ring into sealing engagement with said end cap.

6. A rotary fluid pressure device as claimed in claim 1, characterized by said seal ring being configured such that its inside diameter is greater than said radially inner surface of said seal groove, and its outside diameter is less than said radially outer surface of said seal groove, whereby said seal ring floats within said seal groove.

7. A rotary fluid pressure device as claimed in claim 1, characterized by said seal ring having a generally rectangular cross section and comprising a steel member.

8. A rotary fluid pressure device as claimed in claim 1, characterized by said backup ring having a generally rectangular cross section.

* * * * *